US006840047B2

(12) United States Patent
Schmahl et al.

(10) Patent No.: US 6,840,047 B2
(45) Date of Patent: Jan. 11, 2005

(54) LINING FOR INNER WALLS OF COMBUSTION CHAMBERS

(75) Inventors: Milan Schmahl, Ruhr (DE); Christine Taut, Dresden (DE); Marc Tertilt, Hattingen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/270,458

(22) Filed: Oct. 15, 2002

(65) Prior Publication Data

US 2003/0079475 A1 May 1, 2003

(30) Foreign Application Priority Data

Oct. 15, 2001 (EP) ..... 01124603

(51) Int. Cl.[7] ..... F27D 1/04; F27D 1/14
(52) U.S. Cl. ..... 60/753; 60/754
(58) Field of Search ..... 60/752, 75.3, 754, 60/786, 880

(56) References Cited

U.S. PATENT DOCUMENTS 2,548,485 A * 4/1951 Lubbock ..... 60/753
2,915,877 A * 12/1959 Darling ..... 60/753
5,363,643 A * 11/1994 Halila ..... 60/752
5,489,074 A * 2/1996 Arnold et al. ..... 244/158 A

FOREIGN PATENT DOCUMENTS

| | | |
|---|---|---|
| CH | 392 359 | 9/1960 |
| DE | 196 43 715 | 10/1996 |
| EP | 0 417 734 | 9/1990 |
| EP | 1 130 219 | 3/2000 |
| FR | 2657675 | * 8/1991 |

* cited by examiner

*Primary Examiner*—Michael Koczo
(74) *Attorney, Agent, or Firm*—Harness, Dickey & Pierce, P.L.C.

(57) ABSTRACT

Disclosed is a lining for inner walls of combustion chambers having essentially plate-shaped shielding elements arranged on the inner walls so as to leave a gap. To introduce efficient sealing off against the penetration of hot gases, porous flow barriers capable of being inserted into the gap between adjacent shielding elements are used. The flow barriers are effective in reducing the air demand. The reduction in the air demand has a positive effect on the stability of the burner flames, the effectiveness of the machine and the pollutant emissions and makes it possible to have a further increase in performance, while adhering to maximum given material temperatures.

25 Claims, 2 Drawing Sheets

Fig. 5
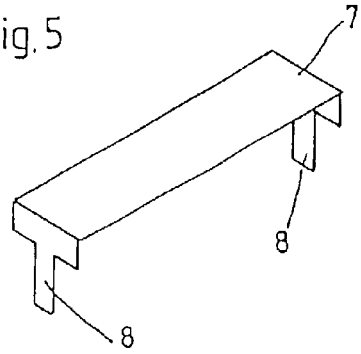
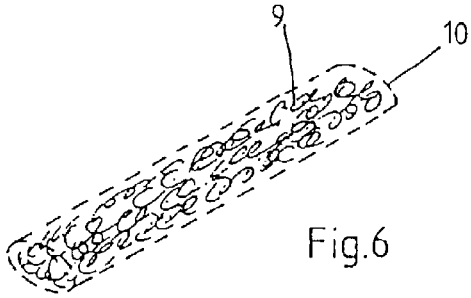
Fig.6
Fig.7
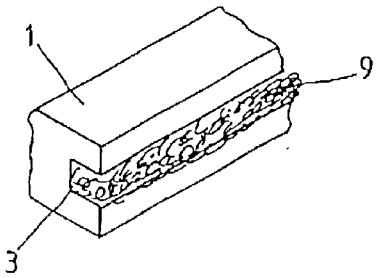
Fig. 9a
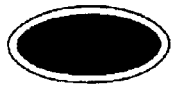
Fig. 9b
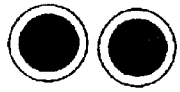
Fig. 9c
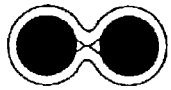
Fig.8
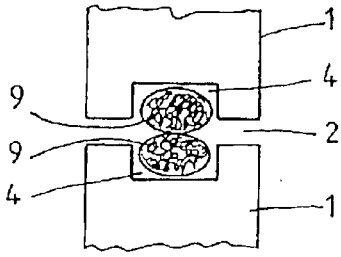

LINING FOR INNER WALLS OF COMBUSTION CHAMBERS

The present application hereby claims priority under 35 U.S.C. §119 on European Patent application number 01124603.0 filed Oct. 15, 2001, the entire contents of which are herein incorporated by reference.

FIELD OF THE INVENTION

The present invention generally relates to a lining for inner walls of combustion chambers and gas turbines, with substantially plate-shaped shielding elements to be arranged on the inner wall so as to leave a gap. The present invention generally relates, furthermore, to flow barriers for use in corresponding linings.

BACKGROUND OF THE INVENTION

Linings for inner walls of combustion chambers, in particular also those for gas turbines, are known in the art. The combustion chambers are lined with essentially plate-shaped shielding elements which are temperature-resistant, "plate-shaped" describing the basic dimension. The shielding elements may also be designed as hollow elements. So that different or non-stationery heat expansions can be absorbed, gaps are normally left between adjacent shielding elements. Since hot gas originating from the combustion chamber can enter these gaps, this being capable of leading to overheating on shielding elements, holding elements or the combustion chamber wall, it is known to introduce barrier air between the combustion chamber wall and the shielding elements, so that the gaps are shut off against the in draft of hot gas.

Some of the barrier air is required for cooling the shielding or fastening elements. The minimum air consumption is defined by the air quantity necessary for cooling the shielding and fastening elements. Ideally, this air quantity required for cooling should also be sufficient for shutting off the gaps. However, it is necessary to have considerably higher air quantities in order to shut off the technically required gaps (heat expansion stationary and non-stationary, manufacturing tolerances, assembly requirements) between the shielding elements. The air demand therefore depends directly on the gap area.

Furthermore, a pressure and temperature field is formed within the combustion chamber. This pressure and temperature field must be taken into account in the dimensioning of the air demand. Locally higher air quantities are therefore necessary. The proposed flow barrier reduces the gap area and thus allows a considerable reduction in the air demand. Moreover, the air demand is largely uncoupled from the pressure and temperature field, thereby affording a further potential for saving.

The lowering of the air demand has a positive effect on the stability of the burner flames, the effectiveness of the machine and the pollutant emissions and makes it possible to have a further increase in performance, while adhering to maximum given material temperatures.

SUMMARY OF THE INVENTION

An object of an embodiment of the present invention is to provide a lining for inner walls of combustion chambers, with essentially plate-shaped shielding elements to be arranged on the inner wall so as to leave a gap, said lining, by being sealed off efficiently, preventing the ingress of hot gases, using an economically available manner.

In one embodiment of the present invention, flow barriers capable of being inserted into a gap between adjacent shielding elements are used.

With the insertion of flow barriers, on the one hand, an ingress of hot gas into the region between shielding elements and the combustion chamber wall can be effectively prevented, and, on the other hand, the cooling air routed in this region can be employed in a specific way, since it now emerges, evened out, through the porous orifices of the flow barriers located in the gaps. Accordingly, the porosity results in a cooling of the sealing elements. In particular, in this case, only a very small amount of air is required for barrier air, thus affording a considerable economic benefit.

The flow barrier may be expediently formed by flexible temperature-resistant sealing elements.

Furthermore, it is advantageously proposed that the sealing elements be of strip-shaped design and thus be capable of being used effectively for sealing off the gaps. Advantageously, the sealing elements may be formed from material contextures, such as knitted wire cloths, wire contextures, fiber contextures, woven fabrics, ceramic fabrics and the like.

It is also possible to produce tubular sealing elements and to fill these, as required, with appropriate material.

Advantageously, the sealing elements are positioned by means of holders into the gap region and fixed there.

According to a further advantageous embodiment of the present invention, the side edges of the shielding elements are provided with grooves, so that stripshaped sealing elements can be positioned in the grooves and consequently so as to conceal the gaps.

The present invention also generally relates to novel flow barriers for use in gaps between shielding elements of combustion chamber inner walls. Flow barriers of this type allow efficient and specific cooling, reduce the barrier air demand and have the effect of higher flame stability and provide the possibility of operating the combustion chamber with a reduced flame temperature.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention may be implemented at a low economic outlay, using suitable materials. Further advantages and features of the invention may be gathered from the following description, with reference to the figures in which:

FIG. 5 shows a perspective view of an alternative embodiment of a sealing element carrier;

FIG. 6 shows a diagrammatic view of a further embodiment of a sealing element;

FIG. 7 shows a perspective view of an inserted sealing element according to FIG. 6;

FIG. 8 shows a sectional view with sealing elements according to FIG. 6; and FIGS. 9*a–c* show sectional views through possible design variants of sealing elements according to FIG. 6.

DETAILED DESCRIPTION OF THE PREFERRED EMBODIMENTS

The same reference symbols are used for identical elements in the figures.

Figure 1:
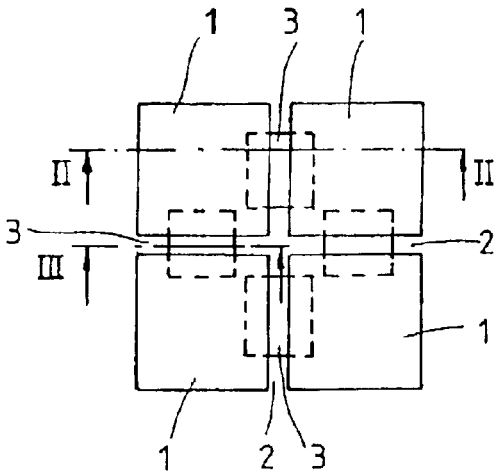
FIG. 1 shows a top view of a shielding element arrangement with diagrammatically illustrated flow barriers.

FIG. 1 shows a basic construction of shielding elements 1 which are arranged, for example, on the inner wall of the combustion chamber and between which are located gaps 2, into which, according to an embodiment of the present invention, flow barriers 3 are inserted. The flow barriers may be permanently mounted guide plates, nozzle plates, material contextures, composite attachments and the like.

Figure 2:
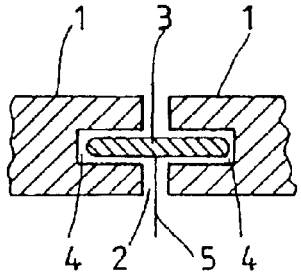
FIG. 2 shows a sectional view along the line II—II according to FIG. 1.
Figure 3:
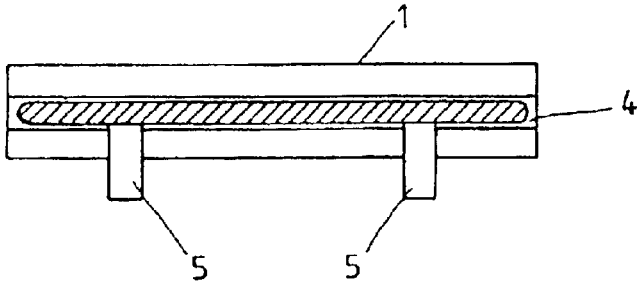
FIG. 3 shows a sectional view along III—III according to FIG. 1.

As may be seen from FIG. 2, according to one embodiment, the side edges of the shielding elements 1 have formed in them grooves 4, into which a substantially bar-shaped sealing element 3 is inserted in order to form a flow barrier. The sealing element 3 has holders 5 which serve for fastening the sealing elements 3, for example in order to avoid arbitrary longitudinal displacement. FIG. 3 shows a corresponding side view.

Figure 4:
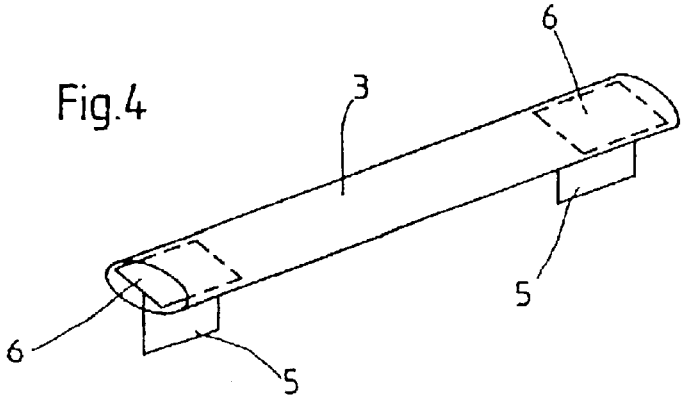
FIG. 4 shows a perspective view of an exemplary embodiment of a sealing element.

FIG. 4 shows an illustration of a corresponding sealing element. In this, the holders 5 are inserted into the sealing element by means of a holder anchor 6, with which they form a T-shaped cross section. The sealing element may be formed of, for example, a woven fabric tube, ceramic or the like, which is filled with corresponding filling materials. Struts may also be provided for reinforcement in the longitudinal direction. FIG. 9*a–c* shows possible design variants of the filled tube.

FIG. 5 shows an alternative holder which comprises a sealing element base 7 and holders 8. The sealing element base 7 may in this case be provided correspondingly with material for sealing off, for example be covered and filled with a textile tube or provided with a contexture, with knitted cloth, foam or the like.

FIG. 6 shows a strand 9 being of a material contexture, for example steel wool or the like, in an elongate shape, indicated by the enveloping curve 10. According to FIG. 7, such a contexture strand, knitted cloth strand or the like 9 can be inserted into a groove 4 of a shielding element 1 and be fixed there, for example by pressing in, adhesive bonding, hooking together or the like. When shielding elements 1 are placed next to one another, sealing off then takes place in the gap 2 by way of the contexture strands 9 resting against one another, as shown in FIG. 8. This parallel arrangement is for sealing off the gap. In each case mutually opposite grooves in shielding elements may be applied to all embodiments of the flow barriers (woven fabric tube, material contexture, guide plate, composite attachments and the like).

The exemplary embodiments shown serve for explanation and are not restrictive.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A lining for inner walls of combustion chambers, having substantially plate-shaped shielding elements to be arranged on the inner wall so as to leave a gap, comprising:

porous flow barriers inserted into a gap between adjacent shielding elements, wherein the flow barrier comprises a tubular element.

2. The lining as claimed in claim 1, wherein the flow barriers are formed by flexible sealing elements.

3. The lining as claimed in claim 1, wherein the flow barriers are formed by strip-shaped elements.

4. The lining as claimed in claim 1, wherein the flow barriers are formed at least partially from a material contexture.

5. The lining as claimed in claim 1, wherein the flow barriers are formed at least partially from a woven fabric.

6. The lining as claimed in claim 1, wherein the flow barriers formed at least partially from ceramic.

7. The lining as claimed in claim 1, wherein the shielding elements have grooves for the reception of flow barriers.

8. The lining as claimed in claim 2, wherein the flow barriers are formed at least partially from a woven fabric.

9. The lining as claimed in claim 2, wherein the flow barriers are formed at least partially from ceramic.

10. The lining as claimed in claim 4, wherein the flow barriers are formed at least partially from ceramic.

11. A lining for inner walls of combustion chambers, having substantially plate-shaped shielding elements to be arranged on the inner wall so as to leave a gap, comprising:

porous flow barriers inserted into a gap between adjacent shielding elements, wherein the flow barriers are positioned at a fixed location by way of holding elements.

12. The lining as claimed in claim 11, wherein the flow barriers are formed by strip-shaped elements.

13. The lining as claimed in claim 11, wherein the flow barriers are formed at least partially from a material contexture.

14. The lining as claimed in claim 11, wherein the flow barriers are formed at least partially from a woven fabric.

15. The lining as claimed in claim 11, wherein the flow barriers are formed at least partially from ceramic.

16. The lining as claimed in claim 11, wherein the flow barriers are formed by flexible sealing elements.

17. A flow barrier for linings for inner walls of combustion chambers, in which substantially plate-shaped shielding elements are arranged on the inner wall of the combustion chamber so as to leave a gap, wherein the flow barrier is designed to be inserted into a gap between adjacent shielding elements and, wherein the flow barrier comprises a tubular element.

18. The flow barrier as claimed in claim 17, wherein the flow barrier is formed at least partially from a material contexture.

19. The flow barrier as claimed in claim 17, wherein the flow barrier is formed at least partially from a woven fabric.

20. The flow barrier as claimed in claim 17, wherein the flow barrier is formed at least partially from ceramic.

21. An arrangement of shielding elements, the arrangement comprising:

a groove formed in a side edge of each shielding element;

gaps formed between adjacently positioned shielding elements; and a flow barrier being inserted in the grooves of at least two adjacently positioned shielding elements, the flow barrier thereby bridging the gap between the at least two adjacently positioned shielding elements, wherein the flow barrier comprises a tubular element.

22. The arrangement according to claim 21, wherein the shielding elements are arranged in a 2×2 matrix form, each shielding element having two grooves for receiving distinct flow barriers, wherein flow barriers inserted into the grooves bridge gaps formed between adjacently placed shielding elements.

23. A flow barrier for linings for inner walls of combustion chambers, in which substantially plate-shaped shielding elements are arranged on the inner wall of the combustion chamber so as to leave a gap, wherein the flow barrier is designed to be insertable into a gap between adjacent shielding elements, and wherein the flow barrier is positionable at a fixed location by way of holding elements.

24. An arrangement of shielding elements, the arrangement comprising:

a groove formed in a side edge of each shielding element;

gaps formed between adjacently positioned shielding elements; and a flow barrier being inserted in the grooves of at least two adjacently positioned shielding elements, the flow barrier thereby bridging the gap between the at least two adjacently positioned shielding elements, wherein the flow barrier is positioned at a fixed location by way of holding elements.

25. The arrangement according to claim 24, wherein the shielding elements are arranged in a 2×2 matrix form, each shielding element having two grooves for receiving distinct flow barriers, wherein flow barriers inserted into the grooves bridge gaps formed between adjacently placed shielding elements.

* * * * *